United States Patent [19]

Bridgehouse

[11] 4,025,100

[45] May 24, 1977

[54] SYNTHETIC FIBER SLING CONSTRUCTION

[75] Inventor: Scott Bridgehouse, Lancaster, Pa.

[73] Assignee: Lift-All Company, Inc., Manheim, Pa.

[22] Filed: Mar. 1, 1976

[21] Appl. No.: 662,601

[52] U.S. Cl. ..... 294/74; 139/411

[51] Int. Cl.[2] ..... B66C 1/12

[58] Field of Search ..... 294/74; 57/139, 140 R, 57/140 BY, 151, 155; 139/408, 409, 411–415; 224/49

[56] References Cited

UNITED STATES PATENTS

| | | | |
|---|---|---|---|
| 3,067,484 | 12/1962 | Rasero et al. | 139/408 X |
| 3,568,726 | 3/1971 | Thompson et al. | 139/415 |
| 3,776,585 | 12/1973 | Bridgehouse | 294/74 |

*Primary Examiner*—Johnny D. Cherry
*Attorney, Agent, or Firm*—Dorfman, Herrell and Skillman

[57] ABSTRACT

A sling particularly adapted for use in hoisting heavy objects. The sling is formed in a predetermined length and has loops at each end for connection to the hoisting equipment or for looping the sling about the load which is to be hoisted. The sling comprises a synthetic fabric which, according to the invention, is woven in three plies in which each ply comprises chain warps extending throughout the length of the ply, the plies being interconnected both by the filling yarns and by connecting binder warps. The fabric incorporates load-carrying yarns disposed on opposite sides of the central ply between the central ply and the outer ply. The loadcarrying yarns are rigid, continuous filament yarns, whereas the warp yarns in at least the outer plies are textured yarns, preferably bulked synthetic carpet yarns. The warp yarns in the central ply are preferably dyed to a contrasting color which may serve to signal the occurrence of wear in the fabric.

4 Claims, 4 Drawing Figures

SYNTHETIC FIBER SLING CONSTRUCTION

The present invention relates to hoisting equipment and has particular application to hoisting slings.

When using slings for hoisting components of heavy equipment and the like, it is important to maintain a close inspection of the sling material in order to avoid using a sling which might rupture and fail during hoisting. Since hoisting equipment is used in areas where workers must be present, any failure of the sling which would allow the load to fall uncontrollably creates danger to the working people present in the hoisting area.

Various techniques have been tested for reducing the possibility of failure of the slings, including the provision of special strands in the sling which, when they become worn, expose a visible signal which is observed by the workers to indicate that that particular sling should be retired from use.

It has also been proposed to strengthen the sling by incorporating into the sling fabric reinforcing strands of wire cable or the like. Although such a reinforcement provides a degree of safety, it also impairs the flexibility of the sling fabric and the ability of the sling fabric to conform to the shape of the load. The use of the wire reinforcement in the webbing construction has the effect of utilizing the webbing as a cover element for the wire reinforcement and when the cover is damaged, the wire reinforcement is exposed which may cause loss of gripping effect on the load and may cause the wire reinforcement to damage the load.

Despite the precautions of periodic inspections of the slings, as well as the presence of wear signals in the sling, there is a tendency for the workers to delay the replacement of the sling, particularly when the replacement slings are not immediately available at the time when the first signs of wear are observed.

With conventional slings, as soon as one of the components of the sling fabric is broken or otherwise fails, the construction of the fabric is such that the entire fabric is weakened and the entire sling fails. Thus, when the sling is brand new, and not subjected to any substantial weaar, inadvertent damage to the sling, for example by sharp objects, may rupture a component of the sling fabric and cause premature failure of the sling at that point. Thus, regardless of the care and caution exerted by the working people, sling failure is a substantial danger to the work force at any location where material is being hoisted by the use of slings and the like.

In my earlier U.S. Pat. No. 3,776,585, I disclosed a sling webbing comprising a three-ply fabric construction having rigid warp yarns and weft yarns comprising a bulked multi-filament synthetic yarn. The fabric construction provided a sling which provides a safety factor in that rupture of one or more components in one of the plies of the fabric does not result in a complete failure of the sling but retains a degree of load-carrying capacity which is sufficient to avoid immediate separation of the sling at the point of rupture. The patented constructon provides a combination of rigid and bulked synthetic yarns which is particularly effective for light and medium duty requirements. For heavy duty use, the sizes of the yarsn, or the number of yarns used must be increased to an extent that the width or thickness of the sling fabric detracts from its utility.

With the foregoing in mind, the present invention provides an improved heavy-duty sling construction which reduces the danger to which the working people are exposed in the area where the sling of the present invention is used.

More particularly, the present invention provides an improved sling construction in which damage to one of the components of the sling does not automatically cause failure of the entire sling, but the load-carryig ability of the sling is maintained, although at a reduced level.

In particular, the present inventon provides a sling in which the sling fabric comprises invention three-ply woven construction which consists of weft yarns interwoven with chain warps confined to each ply. The plies, in turn, are interconnected by connecting binder warps which connect the outer plies to the central ply. The yarns of the fabric construction are a combination of rigid, bulked, and/or stretch yarns arranged in a particular manner to provide improved strength and resistance to failure.

All of the objects of the invention are more fully set forth hereinafter with reference to the accompanying drawing, wherein.

Figure 1:
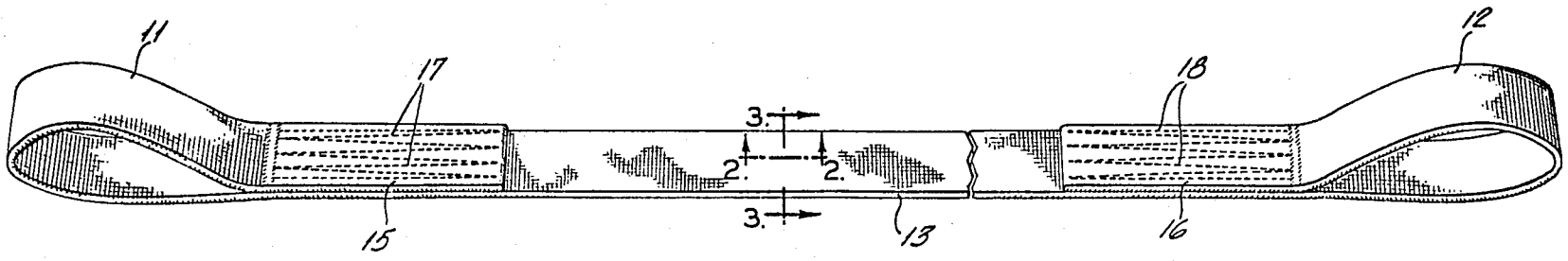
FIG. 1 is a plan view of a sling enbodying the present invention.

With reference to the drawing, the sling illustrated in FIG. 1 comprises a length of narrow fabric webbing which is folded back on itself at each end and sewn together to form sling eyes at each end which permit the sling to be connected to the hoisting equipment, and also permit the sling to be looped into itself to form a load-engaging noose. In the present instance, the sling comprises a single length of webbing wherein the free ends of the webbing are along the length of the sling between the loops formed at each end. For the purpose of description, the loop bights of the sling are designated 11 and 12. On one side of the sling, the webbing fabric is in a continuous run 13 extending continuously from one bight 11 to the other bight 12. On the other side of the sling, the webbing fabric is provided with a double thickness by reason of the two end portions as indicated at 15 and 16, respectively. The runs of webbing 13, 15 and 16 are sewn into face-to-face engagement along their length of overlap by stitching indicated at 17 and 18. In the form of sling shown in FIG. 1, the end portions 15 and 16 are sewn to the continuous run 13 so as to form flat eyes in the bights 11 and 12. An alternate form of loop, i.e., the twisted loop, may be formed by sewing the webbing ends to the continuous run by twisting each end on its axis prior to being sewn. Where it is desired to use the sling with hooks, cables or other equipment, metallic fittings may be secured in the bight at one or both ends. Other standard sling arrangements may also be employed, including the fabrication of the sling into an endless loop having bights at both ends.

Figure 3:
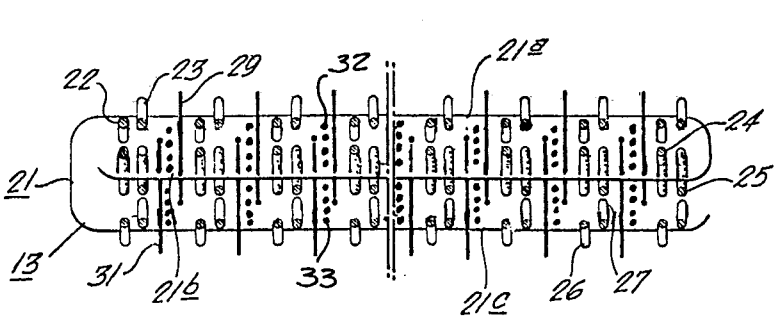
FIG. 3 is a transverse diagrammatic sectional view of the weave construction as indicated by the lines 3—3 of FIG. 1.
Figure 2:
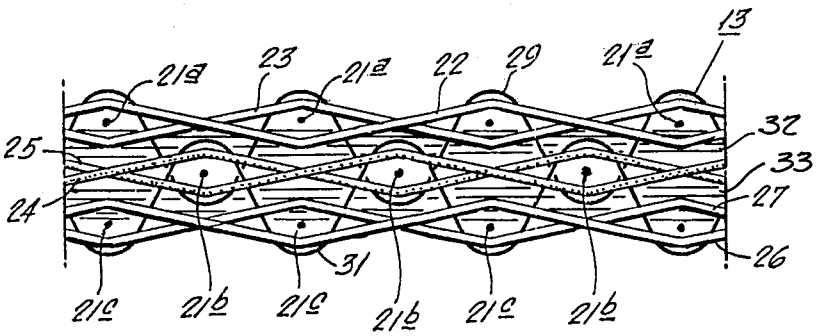
FIG. 2 is a longitudinal diagrammatic sectional view through the sling weave construction embodied therein as indicated by the lines 2—2 in FIG. 1.

The webbing of the sling is of a fabric construction which provides a safety factor which delays failure of the entire sling when one of the components of the fabric fails, due to wear or to severance by harsh handling. As shown in FIGS. 2 and 3, the fabric construction is a three-ply construction. The upper ply of the fabric consists of weft elements 21*a* which are interwoven by chain warps 22 and 23, in the present instance in a plain weave construction. The central ply comprises weft elements 21*b* and central chain warps 24 and 25, likewise in the present instance interwoven with a plain weave construction. The bottom ply likewise consists of elements 21*c* and chain warps 26 and 27. In each ply, the weft elements and the chain warps make up a self-sustaining fabric which will retain its integrity apart from the other plies.

The three plies are integrated, as shown, into a composite fabric, not only by weft elements 21*a*, 21*b* and 21*c*, which are parts of a continuous weft strand 21, as shown in FIG. 3, but also by means of additional connecting binder warps 29 best shown in FIG. 2 which interweave between the upper and middle plies and connecting warps 31 which interweave with the central and lower plies. As shown in FIG. 2, the binder wraps on one side of the composite fabric pass around each weft component of the outer ply and around each weft component of the central ply alternately. As shown in FIG. 2, in the present instance, the weft components of the outer plies are offset between the weft components of the central ply.

Figure 4:
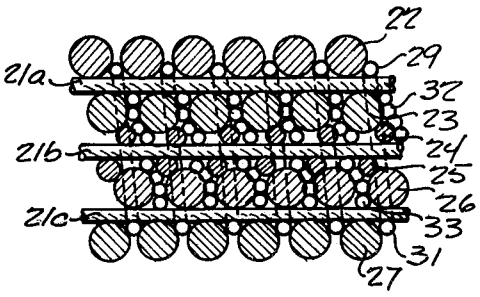
FIG. 4 is an enlarged cross section showing the relationship of the actual yarn components.

In order to provide maximum strength, the composite fabric includes, in addition, a plurality of load-carrying yarns extending throughout the length of the fabric between the plies. The yarns are arranged in two groups, respectively, above and below the central ply of the fabric. The yarns in the upper group are designated 32 and the yarns in the lower group are designated 33. As indicated in FIG. 2, the yarns 32 and 33 extend longitudinally throughout the entire length of the fabric between the plies. Thus, the yarns may be extended in a straight fashion without kinks or crimps which detract from the load-carrying capacity of a yarn. Thus, when the sling is tensioned, the yarns 32 and 33 constitute the major load-carrying components of the sling, the yarns being held in place between the plies by the connecting warps 29 and 31 and the weft element 21. The physical relationship of the various yarn components of the sling is illustrated in FIG. 4 where it is apparent that the upper strength yarns 32 are confined between the weft elements 21*a* and 21*b* and the lower strength yarns 33 are confined between the weft elements 21*b* and 21*c*.

By utilizing the yarns 32 and 33 as the load-carrying elements, the chain warps may be composed of a yarn designed to perform other functions. In the present case, the chain warps in the outer plies, designated 22, 23, 26 and 27, are designed to maximize abrasion resistance, and in the illustrated embodiment are carpet yarns which have good covering capacity as well as abrasion resistance. Thus, these yarns may serve as protective sheaths for the interior elements, including the strength yarns 32 and 33, the central chain warps 24 and 25 and the connecting warps 29 and 31. In like manner, the central chain warps may be designed without regard to the tensile load-carrying capacity. In the present case, the warps 24 and 25 are designed as signal elements and to this end, are dyed with a prominent contrasting color. The central ply is hidden when the fabric is intact, and is exposed only in the event of damage to one of the outer plies. Since the tensile load-carrying function is removed from the central ply, the dye used in the yarns 24 and 25 may be selected without regard to the possible deleterious effect of the dye on the tensile strength of the yarn.

Thus, the present invention provides a fabric wherein the functional purpose of each yarn is clearly defined so as to permit selection of yarns to maximize their utility.

In accordance with the invention, the connecting warps and the load-carrying warps of the fabric construction are rigid, continuous-filament, synthetic yarns, i.e., synthetic yarns which have not ben textured or otherwise treated to become stretch or bulked yarns. The rigid synthetic yarns are flexible in the sense of being capable of bending along their axis but are rigid in the sense that they cannot be extended except by actual stretching of the filamentary components of the yarn. To insure maximum flexibility laterally, thereby assuring conformability of the webbing to the load, these warp elements are preferably multi-filament yarns having a soft twist therein. The weft elements are also rigid continuous filament synthetic yarns. The chain warps, on the other hand, are bulked yarns. The bulked yarns are characterized by the fact that they are multi-filament and that the individual filaments of the yarn are crimped, pigtailed, entangled or otherwise distorted so as to produce an enlarged cross section in the filament bundle. By incorporating such bulked yarn as the chain warps in the outer plies in particular, the elements resist raveling in the event of rupture of one of the components of the fabric construction. Although it is preferred to use a continuous filament synthetic yarn in the weft, multi-filament yarns having discontinuous filaments have been employed without substantial loss of effectiveness as far as strength and durability are concerned. However, the tactile and visual characteristics of the webbing are affected by the choice of continuous or discontinuous filamentary material. In the present instance, continuous filamentary material is preferred. In the preferred construction, the rigid yarns are high tenacity nylon yarns whereas the textured yarns are polypropylene. The bulked polypropylene yarns in the outer plies are carpet yarns which exhibit high abrasion resistance and provide an excellent wear surface on each side of the sling fabric. The bulked polypropylene yarns in the center ply are dyed red to provide a wear signal. A fabric which is two inches in width using 2400/1 polypropylene in the chains, 1260 continuous-filament high tenacity nylon in each of the load-carrying yarns and 1260 2-ply continuous filament high tenacity nylon may be designed with various warp and filling counts to provide the tensile strength desired for sling use. As indicated above, the present invention permits a wide selection of yarn characteristics suited to the particular end use desired. For example, it may be preferred to use a polyester in the load-carrying yarns, and the chain warps may have stretch characteristics.

While a particular embodiment of the present invention has been illustrated, the invention is susceptible to various modifications. Not only is arrangement of the webbing in the sling variable as noted above, but also the weave construction may be varied without departure from the invention. For example, although a plain weave has been illustrated in each of the plies, other weave forms may be used, alone or in combination, and the mode of connecting the outer plies to the center ply may be varied by altering the pattern of the connecting warps. The present construction has the same warp and weft density in all three plies, but the densities may be varied to accommodate the construction to special uses. Furthermore, signal yarns have been incorporated into the weave construction in the central ply to signal when the sling has been subjected to sufficient wear or hard usage to justify replacement.

The integrity of the sling is maintained by use of the construction of the present invention in the event of damage to the weave, for example through wear or damage to the warps in the outer ply. The destruction of one of the outer plies and particularly if the ply is damaged across the full width of the webbing, although the integrity of such ply may be destroyed by destruction of the components, the integrity of the remaining two plies remains substantially unimpaired so that the strength of the sling is not lost completely. It has been found that the slings made in accordance with the present invention exhibit substantially greater durability and the lengths of webbing are less subject to damage during the sewing operation in fabricating the webbing into the slings. Furthermore, since a safety factor is obtained by the fact that the integrity of the sling is retained even after destruction of a single ply in the outer surface, the slings may be used for less strenuous requirements after the sling shows the first signs of wear.

Modifications to the illustrated embodiment of the invention have been suggested, and the invention is not limited to the specific embodiments illustrated and described. Other changes and modifications may be made therein and thereto in the scope of the following claims.

I claim:

1. A sling for use with hoisting equipment, comprising a length of fabric webbing having means forming a loop or bight at each end thereof, said fabric webbing comprising a three-ply fabric construction having in each ply weft components and chain warps interconnecting said components to form a self-sustaining fabric construction therein, load-carrying warps extending along the length of the fabric between said plies on opposite sides of the central ply, said load-carrying warps being integrated with the plies on opposite sides thereof by connecting binder warps, each binder warp being interwoven with one ply at the surface of said webbing by passing around a weft component in said one ply and with the central ply by passing around a weft component in said central ply whereby said binder warp is confined to only two of said three plies, each of said binder warps, said weft components and said load-carrying warps being a rigid, continuous-filament synthetic yarn, each of said chain warps being a textured, multifilament synthetic yarn.

2. A sling according to claim 1 wherein said binder warps are multifilament yarns.

3. A sling according to claim 1 wherein said sling comprises a single length of webbing having its end portions folded back to overlie itself to form loops at each end, said overlaid portions being sewn together by thread composed of the same synthetic fiber as the warp and weft yarns.

4. A sling according to claim 1 wherein said chain warps and weft elements in each ply comprise a plain weave, the warp and weft densities in all of the plies being substantially equal.

* * * * *